US010532483B2

(12) United States Patent
Vatome et al.

(10) Patent No.: US 10,532,483 B2
(45) Date of Patent: Jan. 14, 2020

(54) MINI PUNCH

(71) Applicant: Spiral Binding Company, Inc., Totowa, NJ (US)

(72) Inventors: Guy Vatome, L'Aigle (FR); Didier Briere, L'Aigle (FR)

(73) Assignee: Spiral Binding LLC, Totowa, NJ (US)

( * ) Notice: Subject to any disclaimer, the term of this patent is extended or adjusted under 35 U.S.C. 154(b) by 352 days.

(21) Appl. No.: 15/265,828

(22) Filed: Sep. 14, 2016

(65) Prior Publication Data

US 2017/0072583 A1 Mar. 16, 2017

Related U.S. Application Data

(60) Provisional application No. 62/218,394, filed on Sep. 14, 2015.

(51) Int. Cl.

| | |
|---|---|
| ***B26F 1/14*** | (2006.01) |
| ***B65H 1/04*** | (2006.01) |
| ***B65H 1/18*** | (2006.01) |
| ***B65H 5/06*** | (2006.01) |
| ***B65H 3/02*** | (2006.01) |
| ***B26D 7/06*** | (2006.01) |
| ***B65H 1/14*** | (2006.01) |
| ***B65H 9/10*** | (2006.01) |
| *B26D 7/26* | (2006.01) |

(52) U.S. Cl.

CPC ..... *B26F 1/14* (2013.01); *B26D 7/0675* (2013.01); *B65H 1/04* (2013.01); *B65H 1/14* (2013.01); *B65H 1/18* (2013.01); *B65H 3/02* (2013.01); *B65H 5/062* (2013.01); *B65H 9/101* (2013.01); *B26D 7/2628* (2013.01); *B26F 2210/02* (2013.01); *B65H 2402/32* (2013.01); *B65H 2404/144* (2013.01); *B65H 2511/10* (2013.01); *B65H 2511/20* (2013.01); *B65H 2801/42* (2013.01)

(58) Field of Classification Search

CPC ..... B26F 1/14; B26D 7/2628
USPC ..... 83/687, 691
See application file for complete search history.

(56) References Cited

U.S. PATENT DOCUMENTS

| | | | | |
|---|---|---|---|---|
| 5,771,768 A * | 6/1998 | Malmstrom | ..... | B23D 35/008 83/571 |
| 6,047,623 A * | 4/2000 | Whiteman | ..... | B23D 35/008 83/571 |
| 6,363,826 B1 * | 4/2002 | Whiteman | ..... | B23D 35/008 83/571 |
| 6,536,321 B2 * | 3/2003 | Whiteman | ..... | B23D 35/008 83/571 |

(Continued)

*Primary Examiner* — Kenneth E Peterson
(74) *Attorney, Agent, or Firm* — Wendi E. Uzar

(57) ABSTRACT

A system for punching at least one hole in at least one sheet-like material. In particular, a device and system that is uniquely configured and sized to be a table top unit for automatic punching of paper. The system has a sheet feeder, a sheet transport module and a punching die module that allows a punching die to be easily changed. The paper being punched by the punching die module is moved only a short distance from the sheet feeder and while the paper is still supported by the sheet feeder. The sheet feeder is located outside the system's housing to facilitate adjustment and troubleshooting. This advantageously allows for a smaller, compact unit that is effective and efficient.

6 Claims, 6 Drawing Sheets

(56) References Cited

U.S. PATENT DOCUMENTS

| | | | | |
|---|---|---|---|---|
| 6,769,339 | B2 * | 8/2004 | Tiamson | B23D 35/008 83/618 |
| 7,255,032 | B2 * | 8/2007 | Ho | B26D 7/2614 83/573 |
| 7,328,642 | B2 * | 2/2008 | Chiang | B26D 7/2614 83/687 |
| 7,404,246 | B2 * | 7/2008 | Chiang | B23P 15/00 234/104 |
| 2003/0036468 | A1 * | 2/2003 | Blank | B23D 35/008 493/8 |
| 2004/0154453 | A1 * | 8/2004 | Kobayashi | B21D 28/12 83/691 |
| 2005/0051017 | A1 * | 3/2005 | Weng | B26F 1/36 83/694 |
| 2006/0249002 | A1 * | 11/2006 | Ho | B26D 7/2614 83/687 |
| 2007/0131074 | A1 * | 6/2007 | Chiang | B26F 1/34 83/628 |
| 2008/0107500 | A1 * | 5/2008 | Cheng | B26F 1/02 412/16 |
| 2009/0183616 | A1 * | 7/2009 | Krauss | B26F 1/40 83/685 |
| 2012/0085215 | A1 * | 4/2012 | Chiang | B26D 7/2614 83/620 |
| 2015/0321373 | A1 * | 11/2015 | Lopez Perez | B26F 1/14 412/16 |

* cited by examiner

MINI PUNCH

FIELD OF THE INVENTION

This invention relates to an automatic punching machine for paper. In particular, an improved punching machine that is sized to be a table top unit for entry level users in crowded environments.

BACKGROUND OF THE INVENTION

Punch machines are commonly used in business and commercial uses for punching holes in paper for mechanical binding of books. Generally automatic punch machines are large standalone units that take up a lot of space. The paper is stacked outside of the machine and is fed fully into the punching device to a punch station in order for the paper to be punched with the use of various motors.

Therefore, there is a need for a compact punch device for the entry level person that is both effective and efficient.

SUMMARY OF THE INVENTION

The present invention is a punch device that is capable of punching holes into stacks of paper.

The system for punching at least one hole on at least one sheet-like material comprises a sheet feeder, a sheet transport module that receives a sheet like material from the sheet feeder and a punching die module adapted that receives the sheet-like material from the sheet transport module.

The punching die module comprises a punching die having means to punch holes in the sheet-like material; a punching die table for receiving the punching die, a handle having a thickness and a plurality of apertures that extend through the thickness, a position pin having a length greater than the thickness, wherein the punching die correspondingly mates with the handle with the position pin extending through the apertures on said handle; a locking pin extending from the handle and protruding from the bottom surface of the handle and a stop block abutting the punching die table for engaging and aligning the punching die to the punching die table.

The sheet feeder of the system of the present invention comprises a feeder tray adapted to receive the sheet-like material in a horizontally stacked fashion, having means to move the sheet-like material upward and downward, an adjustable arm is positioned above the sheet-like material and is movable in a first horizontal direction and a plurality of foot pusher solenoids attached to the adjustable arm for engaging and moving the sheet-like material from the sheet feeder to the sheet transport module and a rear paper stop attached to the adjustable arm for aligning a first edge of the horizontally stacked sheet-like material.

The sheet feeder of the present invention may further comprise a side jogger adapted to position above the sheet-like material movable in a second horizontal direction, a front paper stop attached to the side jogger for aligning a second edge of the horizontally stacked sheet-like material and a detection cell adapted to position above the sheet-like material for signaling the movement of the feeder tray so that the horizontally stacked sheet-like material are at a pre-determined position.

The sheet transport module of the present invention comprises a main beak movable in and out in a horizontal position for pulling multiple pages of sheet-like material from the stack of sheet-like material, a separator beak attached to the main beak movable in and out in said horizontal position for separating a predetermined number of pages of sheet-like material from the stack of sheet like material, a hammer movable up and down in a vertical position for pinching the predetermined number of pages of sheet-like material separated by the separator beak and pulled by said main beak; a first pair of rollers movable up and down in a vertical position rotating in a first direction, a second pair of rollers fixedly positioned below the first pair of rollers rotating in a second direction opposite of the first direction; and a solenoid that activates the first pair of rollers and said second pair of rollers wherein the first and second pairs of rollers cooperatively engage to pinch and move the predetermined number of pages of sheet-like material from the main beak to the punching die module.

BRIEF DESCRIPTION OF THE DRAWINGS

Preferred embodiments of the present invention have been chosen for purposes of illustration and description and are shown in the accompanying drawings forming a part of the specification wherein.

DETAILED DESCRIPTION OF THE PREFERRED EMBODIMENT

Figure 1:
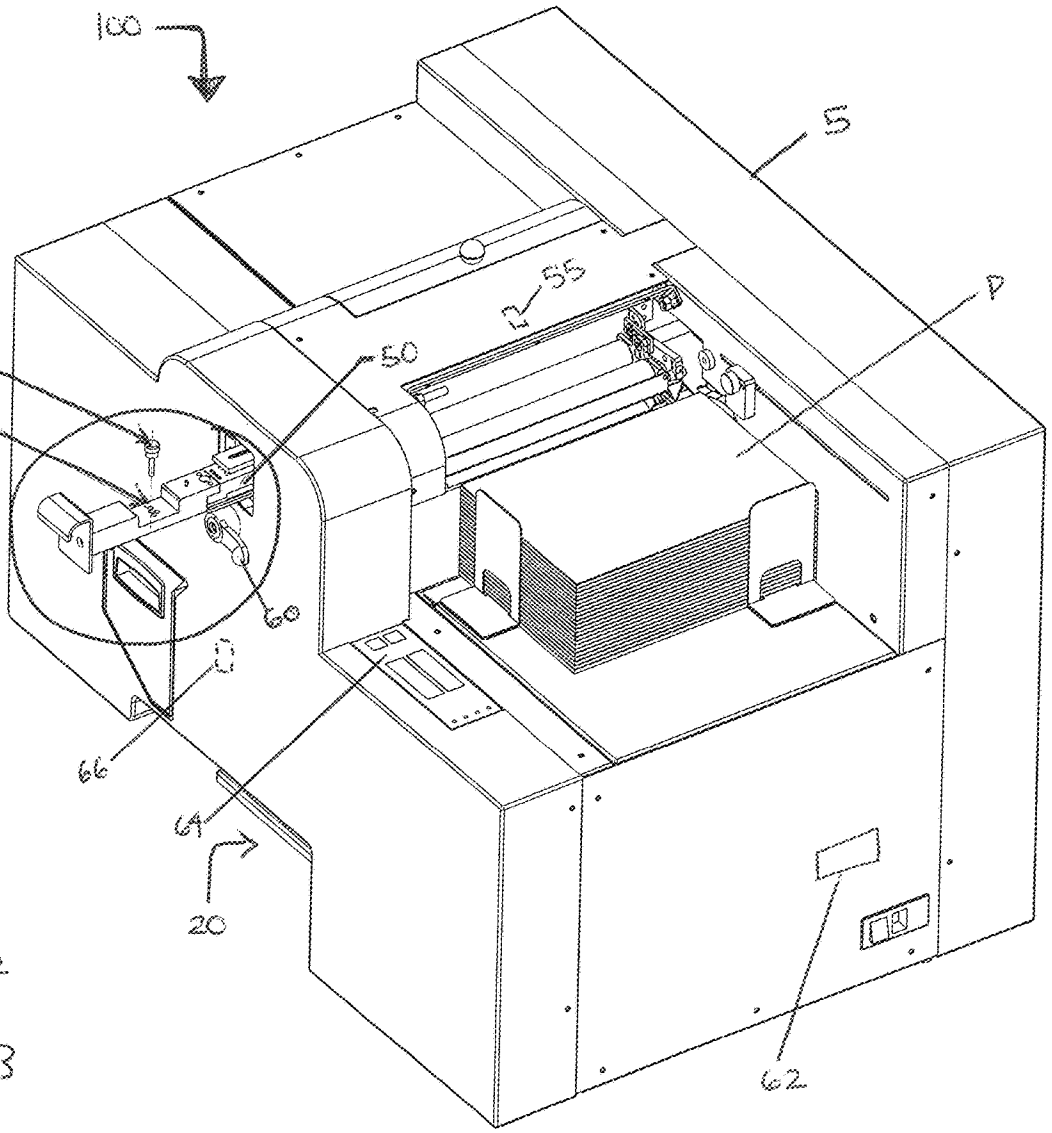
FIG. 1 is a perspective view of the present invention with the punching die module partially extending outside the housing and is shown with a prior art sheet feeder.

With reference to the drawings, FIGS. 1-4 show the mini punch system, device or machine 100 of the present invention comprises a housing 5, a sheet feeder 10, a sheet transport module 30, a punching die module 40 and a paper output 20.

Figure 2:
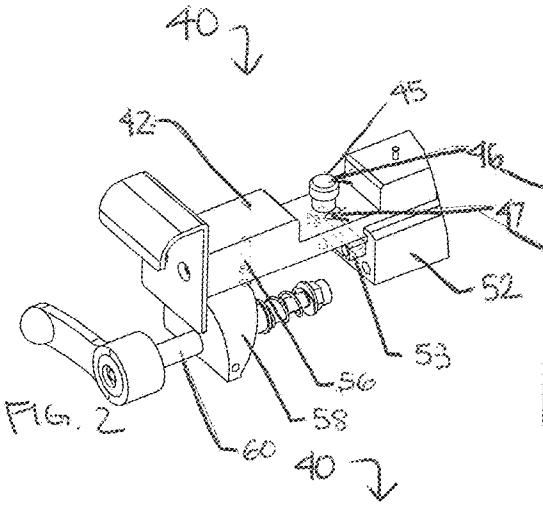
FIG. 2 is an enlarged perspective view of a portion of the punching die module of FIG. 1.
Figure 3:
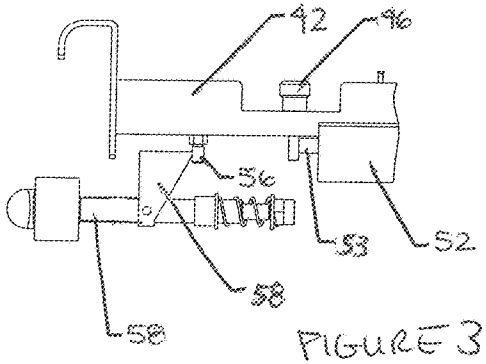
FIG. 3 is an enlarged side view of a portion of the punching die module of FIG. 1.
Figure 7:
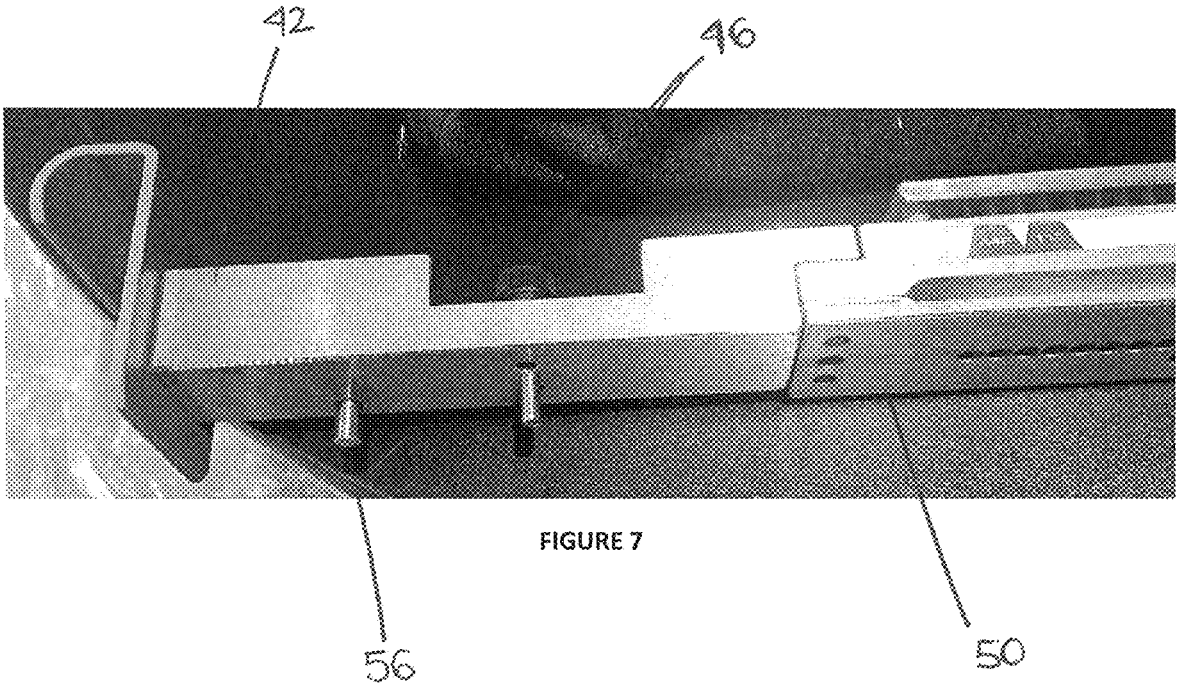
FIG. 7 is a perspective view of the handle and punching die of the punching die module of the present invention outside the housing.
Figure 8:
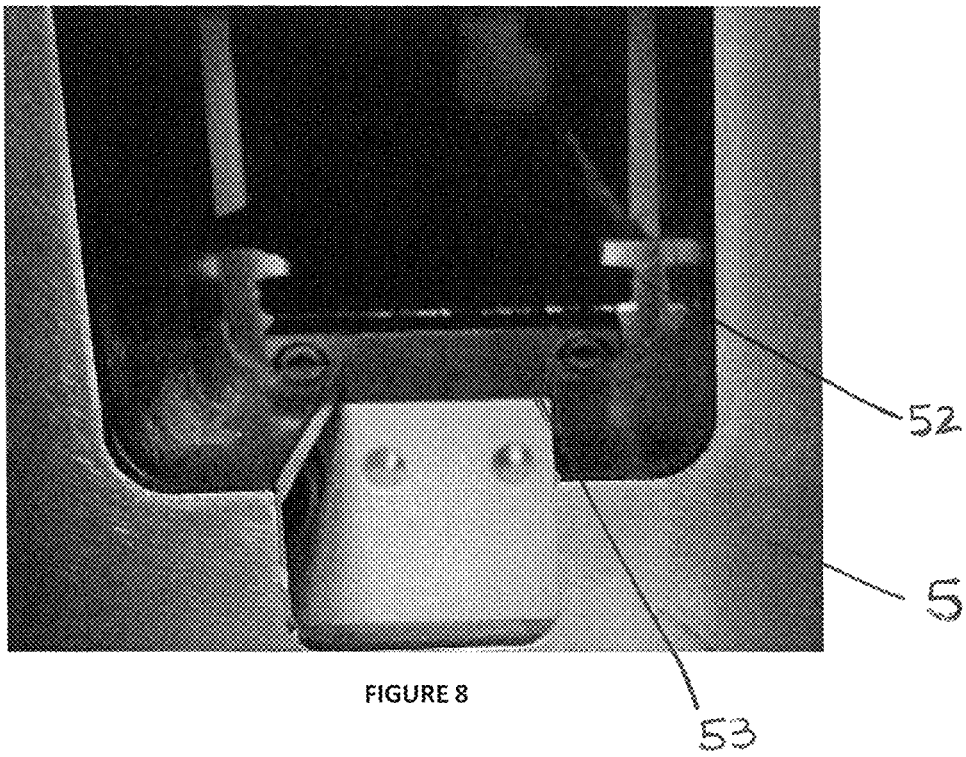
FIG. 8 is a perspective view of the punching die table and stop block of the punching die module of the present invention in the housing, with the punching die module removed from the housing.

As shown in FIGS. 1, 2 and 3 the punching die module 40 comprises a punching die 50 that is connected to a handle 42 that is capable of self-positioning and locking the punching die module 40 in the housing 5. Punching die module 40 is slidably insertable to be positioned within housing 5. FIG. 1 shows the punching die module 40 partially extending outside the housing 5. FIGS. 2 and 3 are enlarged views of the portion of the punching die module 40 that is outside the housing 5 as shown in FIG. 1. As a lift of paper P on the sheet feeder 10 that is fed is registered against one side of the punching die module 40, the lateral position of the punching die 50 will depend on the punching pattern, the pitch that is desired by the user, and/or the width of the sheets that are being punched so that the punched holes are correctly centered and aligned across the sheet. To achieve this, the handle 42 of the punching die module 40 has a plurality of apertures 47, or holes, that are positioned to correspond to the standard sheet format widths for the specific punching pattern or pitch of the relevant punching die 50. A punching die is shown in FIG. 7. Different punching dies 50 can be interchanged and connected to the handle 42 and used with machine 100 depending on the punching configuration the user desires. A label or indicator is provided next to the holes 47 to indicate the various formats and numbers of punching holes that correspond to the holes. For example, one format is for 32 holes positioned along a 11" long paper with 3:1 pitch punching die 50 in the machine. The handle 42 further comprises a position pin 46 that fits within the holes 47. The positioning pin 46 may be capped by a knob 45 to be easily manipulated by the user. It is contemplated that the knob 45 be made of plastic. The punching die handle 42 has a thickness. The length of the positioning pin 46 is greater than the thickness of the punching die handle 42 as shown in FIG. 3. The punching die module 40 further comprises a punching die table 52 which is located within the housing 5. The punching die table 52 acts as a track and slidably receives the punching die 50 thereon. See FIG. 8. A stop block 53 is fixed within the housing 5 and abuts the punching die table 52 at the first end of the punching die table 52. The punching die module 40 has a locking pin 56 fixed on the bottom surface of the handle 42. The punching die module 40 further comprises a spring loaded rotating lever 60 fixedly positioned at the housing 5 (See FIG. 1). The rotating lever 60 is located under the punching die module 40 and is connected to a cam 58 located inside the machine housing 5. The method of setting the punching die 50 to the correct position comprises the steps of: pull/slide with the handle 42 of the punching die module 40 out of the machine housing 5 on the punching die table 52; insert the position pin 46 in the hole 47 corresponding to the sheet width and the number of holes to be punched; push/slide with handle 42 connected to the punching die 50 back in place in the housing 5 on the punching die table 52 and rotate the spring loaded rotating lever 60 to lock the punching die module 40 in position. When the punching die module 40 is slid back into place on the punching die table 52 within the housing 5, the bottom of the position pin 46 will abut the stop block 53 which will position the punching die module 40 into the correct lateral position for the chosen format and hole number. The punching die table 52 and stop block 53 of the punching die module 40 is shown in FIG. 8 with the punching die 50 removed from the machine 100. In FIG. 8, the punching die table 52 can be seen within the housing 5 where the punching die 50 can be slid into the machine 100. The stop block 53 can also be seen in FIG. 8.

By turning the spring loaded rotating lever 60 when the punching die module 40 is in position, the cam 58 pushes against the locking pin 56 and the punching die module 40 is locked in between those two fixed positions and is ready to operate.

It is unique and novel the way the punching die 50 is set to the size of paper by moving the positioning pin 46 to various positions on the handle 42. Most prior art machines move the paper to the die. In the present invention the punching die 50 is positioned by putting the positioning pin 46 in the correct hole 47 for the size of the paper sheet being punched. The punching die 50 is pushed/slid forward and into the housing 5 until the bottom of the positioning pin 46 abuts the stop block 53. This sets the punching die 50 to the correct location on the punching die table 52 for operation. The user then turns the lever 60 to lock the punching die 50 in place on the punching die table 52. The lever 60 turns a cam 58 until it engages locking pin 56. This makes it very easy for the operator to set up and change the punching die 50 needed and holes to be punched. The sheet transport module 30 and sheet feeder 10 of the present invention are not shown in FIG. 1. FIG. 1 shows a prior art sheet feeder. The sheet transport module 30 and sheet feeder 10 of the present invention are shown in FIG. 4.

Figure 4:
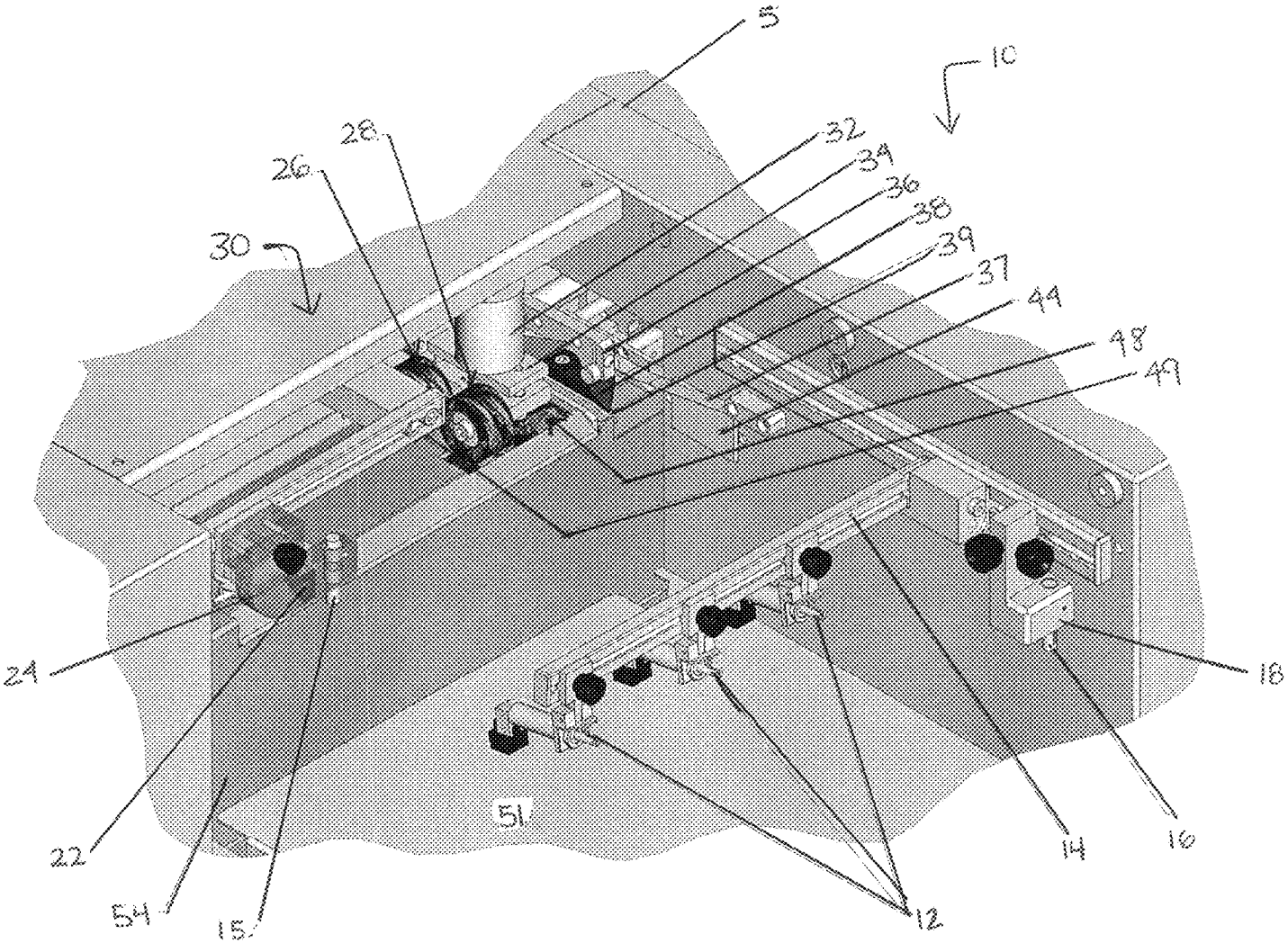
FIG. 4 is a perspective view of the sheet transport module and sheet feeder of the present invention, to be used in conjunction with the punching die module of FIG. 1.
Figure 5:
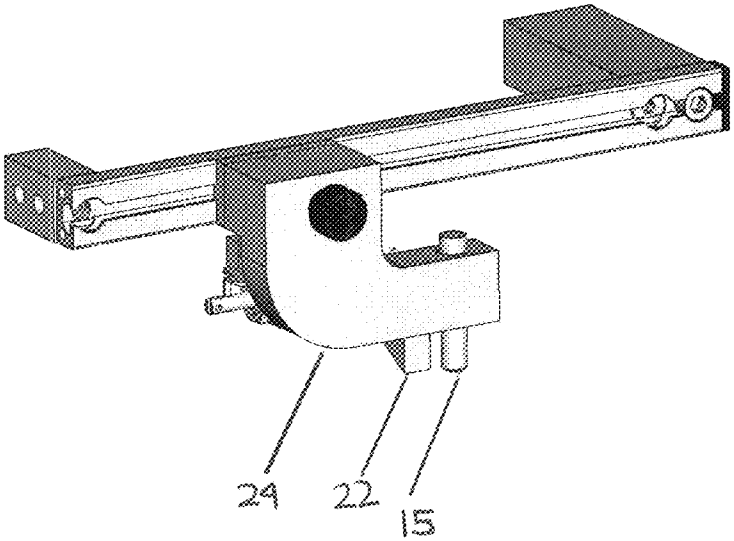
FIG. 5 is a perspective view of the side stop and paper stop of the present invention.
Figure 6:
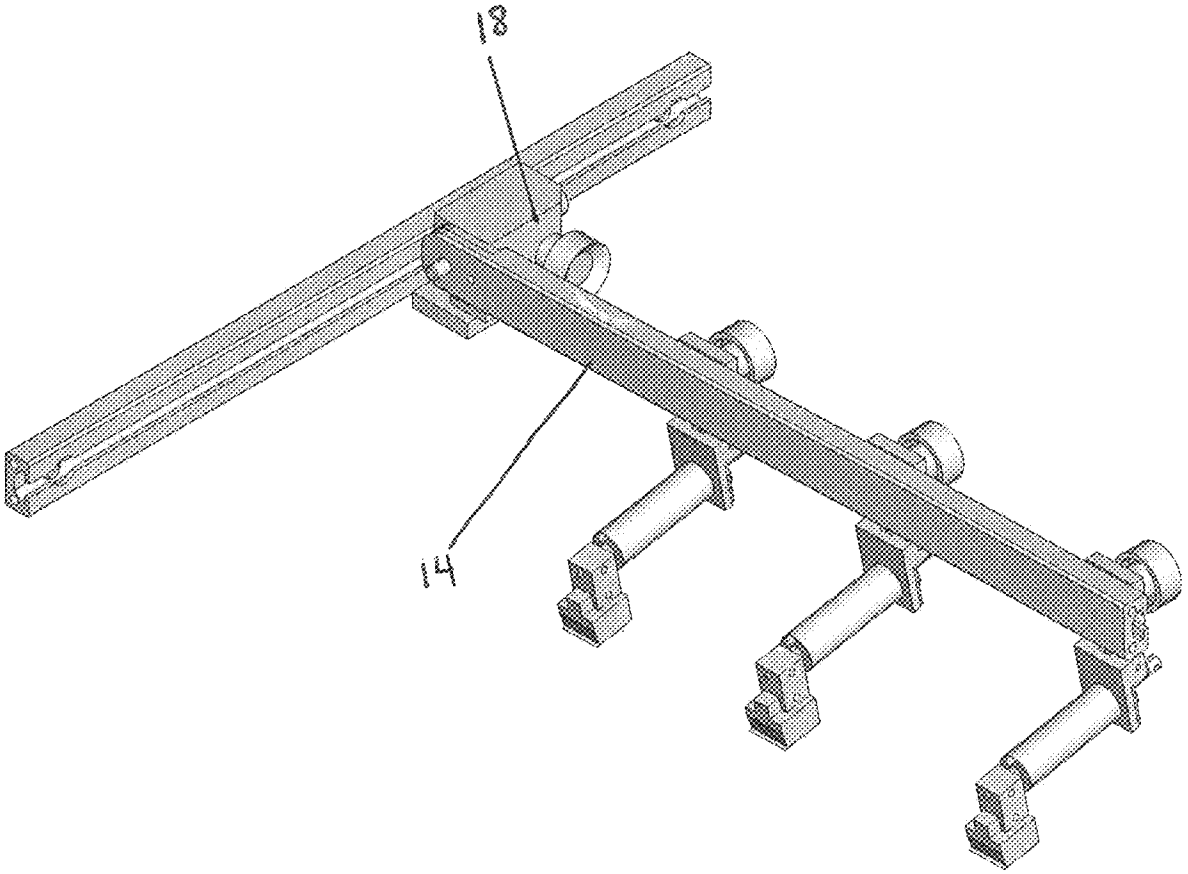
FIG. 6 is a perspective view of the adjustable arm of the present invention and the rear stop where the paper stop is located.

The sheet feeder 10, as shown in FIG. 4, comprises a high pile feeder tray 51, an adjustable arm 14 that has a plurality of foot pusher solenoids 12 attached thereto, an adjustable side jogger 22, a detection cell 54 and its reflector 44. The transport module 30 includes a sub-assembly incorporating the main beak 38, the separator beak 39, the hammer 36, and a pressure spring 37. Each foot pusher solenoid 12 aids in pushing/moving the paper from the sheet feeder 10 to the transport module 30. They push the lift of paper, to be punched, to the head stops of the punching die 50. The head stops are part of the punching die 50 where the paper are aligned against to allow the punching die 50 to properly punch holes on the paper. The side jogger 22 aids in the alignment of paper along one edge as it pushes and aligns the paper against the side stop 24 and the front paper stop 15. This puts the paper in the correct alignment for receipt by the transport module 30 and then subsequently for the punching die 50 to punch. The detection cell 54 controls the rise of the stack of paper on the feeder tray 51. The stack of paper is prevented from rising above the correct position for the main beak 38 and separator beak 39 to operate. The main beak 38, separator beak 39 move in and out in a straight line. The hammer 36 moves up and down to pinch the lift of paper the main beak 38 and separator beak 39 have separated from the stack of paper on the feeder tray 51. That lift of paper is brought to the opening of the machine 100 to be received by the transport module 30. The hammer 36 releases the lift and the first set of rollers 28, 26 move down to pull the lift of paper into the punching die module 40. Signaled by the detection cell 54 and its reflector 44, the feeder tray 51 moves up to present the next lift of paper in front of the beaks 38 and 39. The process then starts all over again. The foot pusher solenoids 12 are mechanically linked to a rear paper stop 16 which aids in the alignment of paper along another edge. Two foot pusher solenoids 12 are used for standard paper and three foot pusher solenoids 12 are used for tabbed sheets. Foot pusher solenoids 12 are made of plastic. They are attached to three solenoids that fire at the correct time to push the lift of paper being punched against the head stops of the die 50. The feeder tray 51 is located outside of the machine housing 5. To use the sheet feeder 10 a stack of collated sheets is loaded on the feeder tray 51 and registered against the rear side of the machine and the front plate of the machine in front of the feeder tray 51 and remain in such position with the aid of front paper stop 15 and rear paper stop 16. The feeder tray 51 moves up and down. In one embodiment of the present invention, the maximum amount of paper to be loaded is two reams of paper. The user then can slide the adjustable arm 14 so that the rear paper stop 16 is positioned against the rear of the paper stack. Then the foot pusher solenoids 12 are also adjusted to abut the top surface of the stack of paper generally centrally. It is contemplated that a fine tuning adjustment is possible for the foot pusher solenoids 12 through an adjusting screw and compression spring to accommodate tabbed sheets for European sheet formats or different stocks of paper. The same adjustment is possible for side jogger 22.

The sheet transport module 30 also includes a sub-assembly with two sets of linked rollers—the second set of rollers 48, 49 on the bottom which are fixedly positioned and the first set of (counter) rollers 28, 26 on the top mounted on a carriage 34 that are capable of being activated (moved up and down) by solenoid 32. The second set of rollers 48, 49 and the first set of rollers 28, 26 are covered by a resilient material ensuring constant grip and allowing for paper weight, material and lift thickness variations. The sheet transport module 30 further comprises a second detection cell 55 and a stepper motor 66 (both within the housing 5) that is capable of driving the first set of rollers 26, 28 and the second set of rollers 48, 49 through a belt and pulley arrangement on the front of the machine 100.

The machine 100 is operated by pressing the start button on the machine keyboard 64 or interactive panel (not shown). The feeder tray 51 will begin to move up until the top of the stack of paper P blinds the detector cell 54 ray interaction with its reflector 44 which will trigger the start of the punching cycle. The speed of the upward movement of the tray 51 is fixed. It controls the bite thickness and the number of sheets to be punched at each cycle. It is pre-set to take 0.3 mm of paper, or 2-4 sheets of 80 gsm paper. The actual number of sheets will also depend on the thickness of the paper. When the punching cycle starts the separator beak 39 that is attached to the main beak 38 support will move out and penetrate the stack of paper and lift the byte that will be punched. The main beak 38 will move out simultaneously from its starting position into the space created in the stack by the separator beak 39, the hammer 36 is activated by a solenoid immediately after the main beak 38 is fully moved out and the hammer 36 will move down by a solenoid and will pinch the lift of sheets to be punched before the main beak 38 moves back in. The main beak 38 will move back in its starting position and pull the lift of sheets to be punched into one of the bottom roller 48 and one of the top counter-roller 28 that are positioned closer to the stack of paper in the sheet feeder 10. The pressure spring 37 function is to guide the lift so it correctly slides inside one of the bottom rollers 48 and one of the counter-roller 28. The hammer 36 and main beak 38 hold the stack of paper until it makes it between the first and second sets of rollers 28, 26, 48, 49. At that point the pressure of the rollers 28, 26 pull the paper into the punching die module 40. It is useful in cases of wavy material which happens with paper that has come out of a copy machine. The first set of rollers 28 and 26 on top drop down to put pressure on the lift of paper against the second set of rollers 48 and 49 on the bottom. At this same time the hammer 36 releases the lift of paper. During this process, the foot of the foot pusher solenoids 12 is timed to periodically extend to push the paper towards the punching die module 40.

The main beak 38 can activated by a cam which is mechanically linked to the cam 58 fixedly positioning the punching die module 40 so both actions are fully synchronized such that there is enough time for the two sets of rollers (48, 49/28, 26) to transport the sheets to be punched into the punching die 50.

Once the lift, or stack of paper, is pulled into one of the bottom rollers 48 and one of the top rollers 28 and released by the hammer 36, the two sets of rollers 48, 49, 28, 26 are activated by the stepper motor 66. The activation signal is provided by an encoder linked to the cam system that activates the punching die 50 and the main beak 38 through programmable logic controller 62 located in the housing 5. The programmable logic controller 62 controls the stepper motor 66, the main beak 38, the solenoids 12, the feeder tray 51, etc. The top counter rollers or first set of rollers 28, 26 turn clockwise and the bottom rollers, or second set of rollers 48, 49 turn counterclockwise, drawing the lift of paper into the housing 5.

The positioning of the second set of rollers, 48, 49 and the first set of counter-rollers 28, 26 is set to allow for the minimum and maximum sheet lengths of paper allowed by the machine 100. The position of one of the bottom roller 48 and one of the top counter-roller 28 to the beak's 38 starting position and to the punching die 50 axis is important so that the front of the lift to be punched would be inserted into an accurate positioning of the sheets into the punching die module 40. The first set of rollers and second set of rollers 28, 26, 48 and 49 are positioned in the front of the punching die 50. The two sets of rollers 48, 49, 28, 26 transport the lift to be punched towards the punching die 50 until the front of the lift hits the head stops that are incorporated into the punching die 50. The front edge of the lift is detected by the position detector cell 55 which then sends a signal to the programmable logic controller 62 commanding the stepper motor 66. This signal triggers the programmable logic controller 62 to send a given number of pulses to the stepper motor 66 for rotating the second set of rollers 48, 49 so the lift is precisely positioned inside the punching die 50 with its front edge aligned with the head stops of the punching die 50. The head stops can comprise a plurality of pins that are longer and move down first. The paper hits the pins and the transport module 30 moves the paper into position. The paper is held on all four sides then the pins of the punching die 50 punch through the lift of paper. The number of pulses is pre-set so that the front edge of the lift will always align with the head stops of the punching die 50.

The position of the positioning pin holes 47 in the punching die 50 will depend on the desired punching pattern. The distance between the pin row holes and head stops will be equivalent to the sheet to hole edge margin. It is on a slide and the cam that moves the main beak 38 also moves this. The rotation of the second set of rollers 48, 49 will be stopped after this number of pulses has been delivered. The encoder will send a signal to the programmable logic controller 62 that will lift the carriage 34 supporting the top counter rollers 28, 26 and activate the side jogger 22 and foot pusher solenoids 12 to ensure square and perfectly aligned punching position of the lift. The carriage 34 will go down and the rotation of the 2 sets of rollers 48, 49 will be reactivated immediately after the punch pin punched the holes in the paper and disengaged, to push the punched lift, or punched paper, outside the punching die 50 and transported to the transport belts on the reception side, transport the next lift, or paper, to be punched into the punching die 50.

Most of the lift of paper is still visible from outside the housing 5 when it is being punched, with the first set of rollers 28, 26 lift up to release the pressure on the lift, or paper. The side jogger 22 and the foot pusher solenoids 12 activate with different solenoids to push the paper to the correct position to be punched. The side jogger 22 and foot pusher solenoids 12 move out of the way and the first set of rollers 28, 36 come down to eject the punched lift of paper to the reception tray of the paper output 20. The cycle can then repeat.

The lift of paper driven by the first set of rollers 28 and 26 and the second set of rollers 48 and 49 which are driven by a stepper motor 66 is unique and novel over the prior art. The use of a stepper motor 66 allows the paper to be transported only a short distance and stay very close to the feeder tray 51. The foot pusher solenoids 12 and side jogger 22 complete the alignment. Also, the lift is still supported by the stack of paper to be fed into the machine 100 when being punched by the punching die module 40. Prior art machines use a regular motor which requires the paper to be punched at a different location of the machine which would require the lift to be moved completely into and through the machine. This invention allows the machine to be more compact as the lift is being moved a short difference and therefore allows for a table top unit. The sheets are registered against the rear paper stop 16 of the feeder tray 51.

Once punched, the paper is transported and re-delivered upside down in the collated order onto a fixed reception tray with an optional pull tray at the paper output 20. Punched sheets can be jogged by magnetic corner plates.

Another unique and novel aspect of the machine 100 is that the side jogger 22 and foot pusher solenoids 12 are located outside of the housing 5 of the machine 100. There are two paper stops 15, 16: one paper stop 15 on the side stop 24 and one paper stop 16 on the rear stop 18 that are also located outside of the housing 5 of the machine 100. The rear stop 18 and side stop 24 are moved until the paper stops 15, 16 are positioned against the side or back of the stack of paper loaded on the feeder tray 51. This in turn sets the position of the side jogger 22 and foot pusher solenoid 12. This allows for a quick and easy set up for the user as the components are easily seen and manipulated as they are located outside of the housing 5 of the machine. This also allows the paper to remain partially in the feeder tray 51 during the punching process as it is not required to fully enter the machine 100 to be punched. This allows the machine 100 to be more compact, requires less travel for the paper to be punched and therefore leaves less room for error.

While the present invention has been described for use with paper, any sheet like material can be used with the mini punch device of the present invention.

What we claim is:

1. A system for punching at least one hole on at least one sheet-like material, comprising:

a) A sheet feeder adapted to receive said sheet-like material;

b) A sheet transport module adapted to receive said sheet-like material from said sheet feeder; and;

c) a punching die module adapted to receive said sheet-like material from said sheet transport module, said punching die module comprises:

i. a punching die having means for punching holes in said sheet-like material;

ii. a punching die table for receiving said punching die;

iii. a handle having a top surface, a bottom surface, a thickness that extends from said top surface to said bottom surface and a plurality of apertures that extend through said thickness;

iv. a position pin having a length greater than said thickness;

wherein said punching die correspondingly mates with said handle with said position pin extending through one of said apertures on said handle;

v. a locking pin extending from said handle and protruding from said bottom surface of said handle; and vi. a stop block abutting said punching die table for engaging said positioning pin to align said punching die to said punching die table, said locking pin being engageable such that said positioning pin is pushed against said stop block.

2. The system of claim 1 further comprising:

d) a cam for selectively engaging said locking pin; and e) a lever connected to said cam for selectively engaging said cam with said locking pin to align and fixedly position said handle and said punching die to said punching die table.

3. The system of claim 1 wherein said punching die table slidably receives said punching die.

4. The system of claim 1 wherein said punching die is interchangeable.

5. The system of claim 1 wherein said lever is rotatably connected to said cam and is spring loaded.

6. The system of claim 1 wherein the sheet-like material is paper.

* * * * *